US008109659B2

(12) United States Patent
Doubek

(10) Patent No.: US 8,109,659 B2
(45) Date of Patent: Feb. 7, 2012

(54) LIGHTING FIXTURE FOR AN ARCHITECTURAL SURFACE STRUCTURE

(75) Inventor: David E. Doubek, LaGrange, IL (US)

(73) Assignee: d2 Lighting, LaGrange, IL (US)

( * ) Notice: Subject to any disclaimer, the term of this patent is extended or adjusted under 35 U.S.C. 154(b) by 479 days.

(21) Appl. No.: 12/422,688

(22) Filed: Apr. 13, 2009

(65) Prior Publication Data

US 2009/0257219 A1 Oct. 15, 2009

Related U.S. Application Data

(60) Provisional application No. 61/044,118, filed on Apr. 11, 2008.

(51) Int. Cl.
*F21V 21/04* (2006.01)

(52) U.S. Cl. ..... 362/370; 362/147; 362/217.12

(58) Field of Classification Search ..... 362/150, 362/217.12, 370, 432, 436, 147, 148, 217.17; 248/229.2, 229.25, 228.6, 231.71, 220.21, 248/220.22

See application file for complete search history.

(56) References Cited

U.S. PATENT DOCUMENTS 5,155,955 A 10/1992 Ball et al.
5,374,812 A 12/1994 Chan et al.
5,386,358 A 1/1995 Hillinger
5,452,816 A 9/1995 Chan et al.
5,613,759 A * 3/1997 Ludwig et al. ..... 362/149
5,758,959 A 6/1998 Sieczkowski
5,842,775 A 12/1998 Roorda et al.
5,943,828 A 8/1999 Samborn et al.
6,979,105 B2 12/2005 Leysath
7,097,332 B2 8/2006 Vamberi
7,152,992 B1 12/2006 Monroe et al.
7,347,597 B2 3/2008 French
2002/0176257 A1 11/2002 Cummings et al.
2005/0257436 A1 11/2005 Vanderpol
2006/0262521 A1 11/2006 Piepgras et al.
2007/0211478 A1 9/2007 Williams et al.
2007/0247842 A1 10/2007 Zampini et al.
2007/0258263 A1 11/2007 Kim
2007/0263379 A1 11/2007 Dowling

OTHER PUBLICATIONS

International Search Report for related international application No. PCT/US2009/040367' report dated Apr. 11, 2008.

* cited by examiner

*Primary Examiner* — Robert May
*Assistant Examiner* — Leah S Lovell
(74) *Attorney, Agent, or Firm* — Miller, Matthias & Hull LLP

(57) ABSTRACT

Lighting fixtures (20) for attachment to architectural surface structures are adapted to hold light sources (100). The lighting fixtures (20) may include a base plate (32) and mounting brackets (34A, 34B). Clamps (80) are provided that may bias the light source (100) in either the forward or rearward direction. The clamps (80) may include spring arms (92) that center the light source (100) within the fixture (20) in addition to retaining the light source (100) in place. The fixtures (20) may further accommodate overlying structures, such as lenses (350). The lighting fixtures facilitate use with a variety of different architectural structures and formation in various shapes.

21 Claims, 21 Drawing Sheets

LIGHTING FIXTURE FOR AN ARCHITECTURAL SURFACE STRUCTURE

CROSS-REFERENCE TO RELATED APPLICATION

This application claims the benefit of U.S. Provisional Application No. 61/044,118, filed on Apr. 11, 2008.

FIELD OF THE DISCLOSURE

The present disclosure relates to lighting systems and fixtures adapted for use with architectural surface structures, and more particularly to lighting systems and fixtures that are attached to surrounding architectural structure and facilitate insertion and removal of light panels.

BACKGROUND OF THE DISCLOSURE

Various types of structures are used to create interior and exterior architectural surfaces, such as walls, ceilings, and floors. Examples of commonly-used construction materials are drywall, thee coat plaster, veneer coat plaster, concrete, stucco, plywood, siding, and wood veneer, among others. Drywall, for example, is a commonly-used construction material that provides an inexpensive yet robust option for constructing walls and ceilings. Large sheets of drywall can be cut and arranged to fit a wide variety of shapes. Gaps can be created by removing a portion from the drywall sheets so that features such as doors, windows, electrical outlets or other desired elements can be provided on the architectural surface. These gaps may be created before or after the drywall sheets are fixed in place. Shaped and cut drywall sheets are generally installed in an internal space by first securing the sheets to a wooden or steel frame. The individual wooden or steel beams that make up the frame are commonly referred to as studs. Once the drywall sheets are secured to the studs, a subsequent installation step includes applying a drywall compound to the seams and corners of the drywall sheets and to any screws and other fasteners used to secure the drywall sheets to the studs. The drywall compound hides any dents or seams in a drywall sheet so as to provide a substantially smooth surface. Typically, a corner bead made from metal or plastic is applied to outside corners before the drywall compound is applied, so as to reinforce the corners and ensure straight corner edges.

The design of architectural surfaces increasingly includes light features for decorative or functional purposes. Recessed lighting, for example, is commonly employed to provide a desired lighting effect. With recessed lighting, the majority of a lighting system is disposed substantially behind or recessed into an architectural surface or feature (such as a soffit). The lighting system typically includes a housing, a light source, such as an incandescent, fluorescent or halogen bulb, and some means for electrically connecting the fixture to a source of operating power. With new construction, the fixture is typically supported by hangers attached to joists. When remodeling, the fixture may be inserted through an aperture formed in an existing surface and attached to the surface material, such that the aperture provides a path for light generated by the light source.

More recently, the options for functional and decorative lighting designs has increased with the advent of newer light sources, such as LEDs, video panels, and other image forming devices. Accordingly, light sources are being incorporated into architectural surfaces in a variety of news ways. Often, the architectural surface is formed with gaps into which light sources are placed. The gaps may have various shapes, such as linear strips, arcuate curves, or other geometric profiles. One or more light sources are inserted into the gaps to provide the desired lighting effect.

Various fixtures have been proposed to secure the light sources to the architectural surfaces. Typically, these fixtures have a relatively large depth profile that necessitates excessive clearance space behind the ceiling, wall, or floor surface. Additionally, such lighting fixtures and systems are overly difficult to install, whether being used in new construction or in remodeling or renovation of existing dwellings. For example, it may be necessary to reframe a wall to add sufficient depth for the lighting fixture, which may also require cutting and reframing window sills, headers, and other architectural features for structural continuity. Conventional fixtures may be thicker than typical wall cavities and therefore require extra framing sizes. The overly bulky conventional fixtures may further interfere with other systems such as HVAC ducts, plumbing pipes, and electrical conduit runs, thereby requiring additional care when planning system layout and coordinating field installation. It is also difficult to insert and/or remove the light source from such conventional fixtures. Still further, conventional fixtures suffer from socket shadow, where light sources arranged end-to-end create light variations on the lens or louver of the fixture.

SUMMARY OF THE DESCRIPTION

A lighting fixture is disclosed for attachment to an architectural surface structure and adapted to hold a light source. The lighting fixture includes a base plate, and first and second mounting brackets. Each mounting bracket includes a rear panel coupled to the base plate and a front panel joined to the rear panel by a side wall to define a receptacle between the front panel and the base plate, the receptacle having a depth defined by a spacing distance between the front panel and the base plate sufficient to receive an edge of the light source, each front panel further defining an inner terminal edge, the first and second mounting brackets being oriented such that the receptacles diametrically oppose one another, the first and second mounting brackets further being positioned such that the front panel inner terminal edges are laterally spaced from one another to define a lighting opening. A first clamp is disposed in the first mounting bracket receptacle, the first clamp including a base end coupled to the base plate, a grip portion configured to engage the light source, and a spring section disposed between the base end and the grip portion and sized to receive a first edge of the light source, the spring section being configured to bias the first edge of the light source toward the base plate. A second clamp is disposed in the second mount bracket receptacle, the second clamp including a base end coupled to the base plate, a grip portion configured to engage the light source, and a spring section disposed between the base end and the grip portion and sized to receive a second edge of the light source, the spring section being configured to bias the first edge of the light source toward the base plate.

An alternative lighting fixture is disclosed for attachment to an architectural surface structure and adapted to hold a light source. The lighting fixture comprises a base plate and first and second mounting brackets. Each mounting bracket includes a rear panel coupled to the base plate and a front panel joined to the rear panel by a side wall to define a receptacle between the front panel and the base plate, the receptacle having a depth defined by a spacing distance between the front panel and the base plate sufficient to receive an edge of the light source, each front panel further defining an inner terminal edge, the first and second mounting brackets being oriented such that the receptacles diametrically oppose one another, the first and second mounting brackets further being positioned such that the front panel inner terminal edges are laterally spaced from one another to define a lighting opening. A first clamp has a base end coupled to the first mounting bracket rear panel and a spring configured to extend at least partially toward the first mounting bracket front panel, thereby to generate a biasing force directed toward the first mounting bracket front panel. A second clamp has a base end coupled to the second mounting bracket rear panel and a spring configured to extend at least partially toward the second mounting bracket front panel, thereby to generate a biasing force directed toward the second mounting bracket front panel.

BRIEF DESCRIPTION OF THE DRAWINGS

For a more complete understanding of the disclosed methods and apparatuses, reference should be made to the embodiment illustrated in greater detail on the accompanying drawings, wherein.

Figure 1:
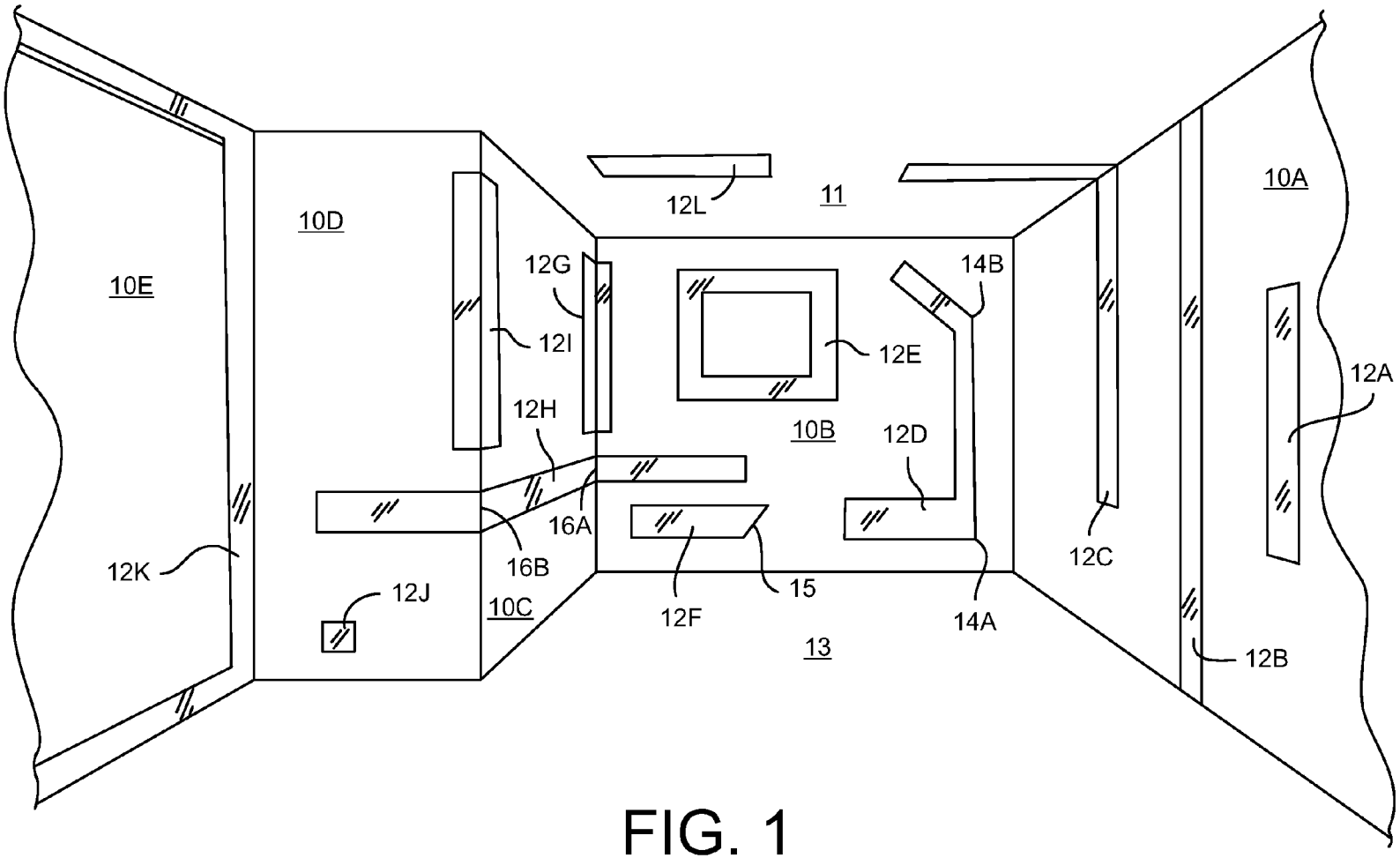
FIG. 1 is a schematic illustration of a room incorporating various types of lighting systems according to the present disclosure.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE DISCLOSURE

Various embodiments of a lighting fixture adapted for attachment to an architectural surface structure and configured to hold a light source are disclosed herein. The lighting fixture facilitates introduction of lighting design elements by providing a structure that is easily incorporated into commonly used architectural surface structures. The disclosed lighting fixtures further accommodate different sizes of light sources. Light sources may be quickly and easily inserted into and removed from the lighting fixture. According to certain features disclosed herein, the lighting fixture may include spring arms and bearing structures to automatically center the light source in the fixture. The bearing structures may also be configured to support a portion of the light source as it is assembled with the lighting fixture, thereby making it easier to install and remove the light source. While the lighting fixture is described herein for use in an interior wall, it will be appreciated that the lighting fixture may be used in any type of interior or exterior architectural surface or feature, including a wall, ceiling, floor, roof, or soffit.

Various embodiments of a lighting system are described below, including embodiments relating particularly to LED-based light sources. It should be appreciated, however, that the present invention is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs. Additional LEDs include RGB, RGGB, and RGBW configurations, as well as LEDs with remote phosphor systems. It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material (positioned either at the die or remotely, such as in a snap-on lens or an intermediary lens) that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term "LED" does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. The lens may have one of many possible distributions, such as wide, narrow, asymmetric, and wall-wash, among others. The lens may be provided directly on the light source or remotely positioned, and may be provided with other components such as remote phosphor, inner or outer prisms, micro-prisms, or holographic prisms. The lens may also be a diffusion lens provided before the final surface lens.

Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to the structure for supporting a light source. A "lighting system" would include both a lighting fixture and a light source.

FIG. 1 illustrates various locations and configurations of lighting systems in which the lighting fixtures disclosed herein may be used. For example, lighting systems 12A, 12B have light sources formed as vertically oriented, elongate strips extending fully or partially along a single wall 10A. Lighting system 12C has a light source that extends along both the wall 10A and a ceiling 11. Lighting system 12D has a light source that extends along a single wall 10B in a pattern that includes a right angle 14A and an obtuse angle 14B. Lighting system 12E has a light source disposed in a single wall 12B and formed in a closed polygon shape such as a rectangle. Lighting system 12F has a light source disposed in the wall 12B and extending as a substantially horizontally oriented strip with a slanted end 15. Lighting system 12G has a light source that is a vertically oriented, elongate strip that spans an inside corner formed between two walls 12B and 12C. Lighting system 12H has a light source that extends substantially horizontally over three walls 12B, 12C, and 12D and includes an inner corner 16A and an outer corner 16B. Lighting system 121 has a light source that is a vertically oriented, elongate strip that spans an outside corner formed between two walls 12C and 12D. Lighting system 12J has a light source disposed in a single wall 12D and formed in a relatively small geometric shape such as a square. Lighting system 12K has a light source that forms a border along a perimeter of a wall 10E. Lighting system 12L has a light source that is disposed in the ceiling 11 and is formed as an elongate strip. In addition to the illustrated embodiments, the lighting system may also be partially or completely disposed in a floor 13. The foregoing merely provides examples of the various shapes and patterns in which the lighting systems may be provided, and is not intended to be exhaustive. In that regard, combinations or further modifications of the foregoing examples may be employed. For example, the lighting system may have a light source that traverses an acute, rather than obtuse, angle, is formed in "open" or "non-polygon" patterns, or has multiple legs of varying length and/or width.

Figure 2:
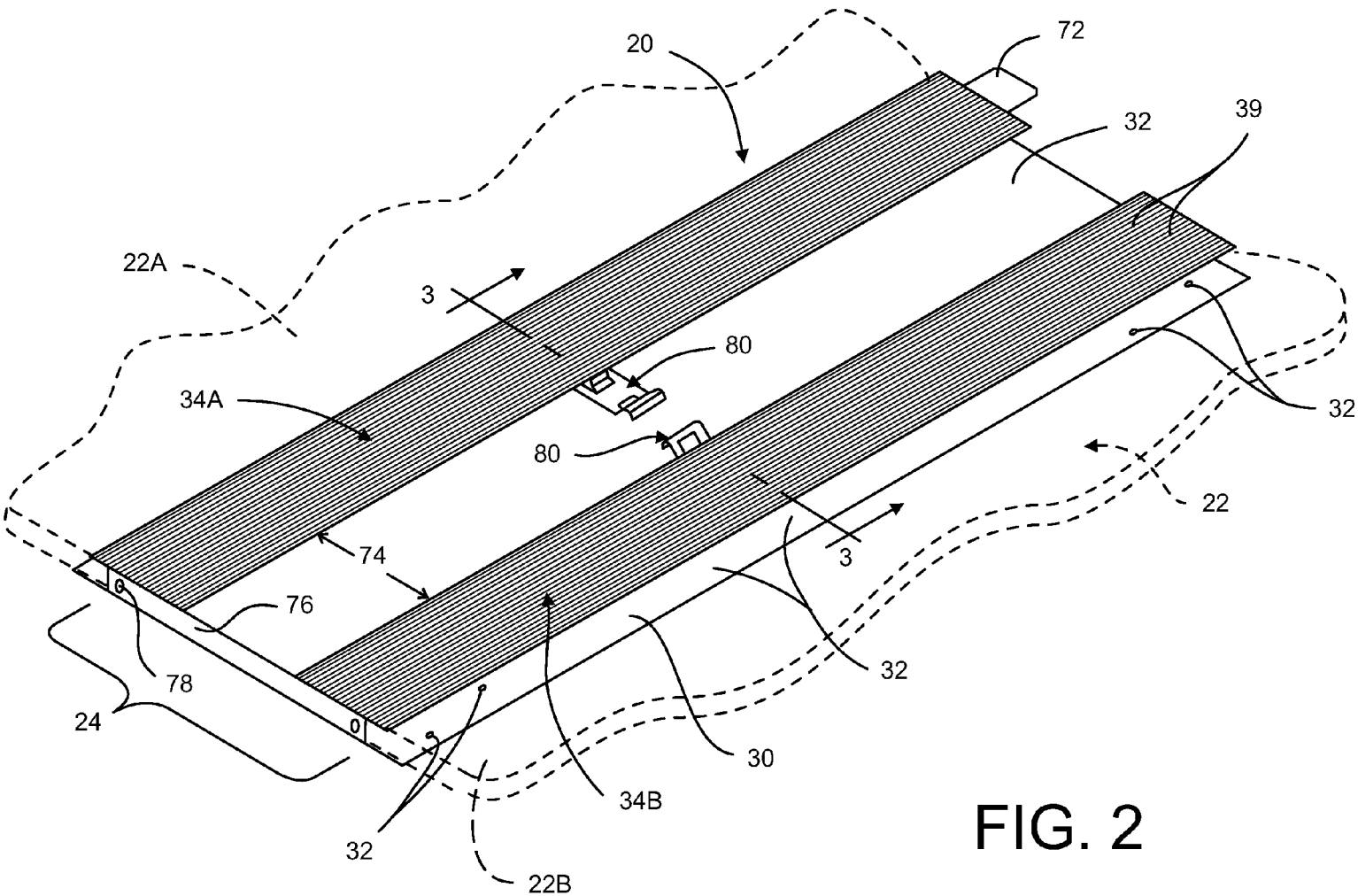
FIG. 2 is a perspective view of a lighting fixture constructed according to the present disclosure.
Figure 3:
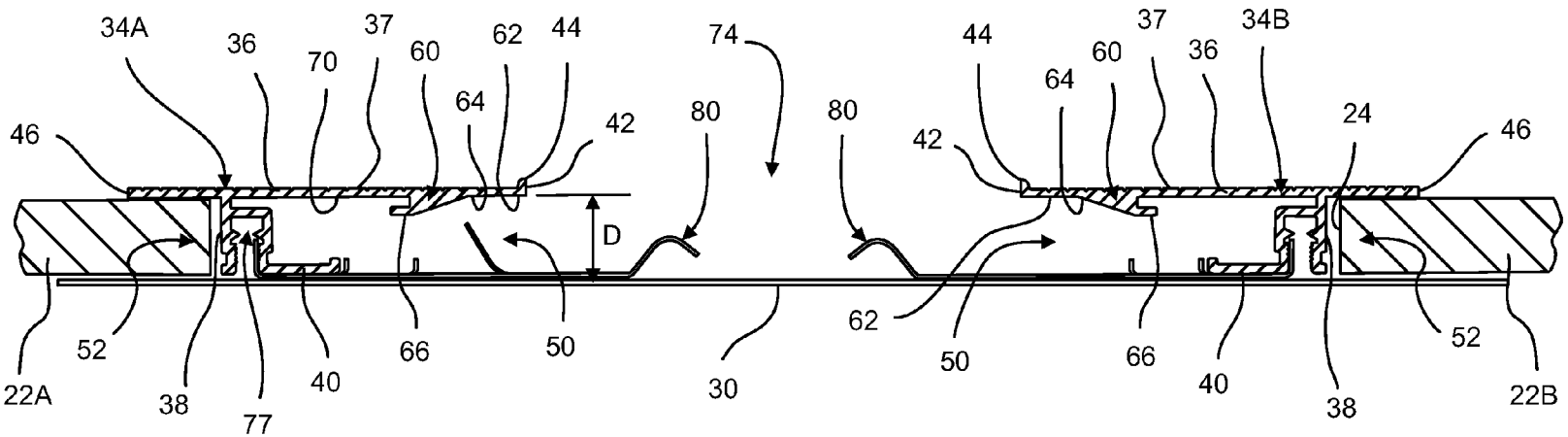
FIG. 3 is a cross-sectional view of the lighting fixture taken along line 3-3 of FIG. 2.

As shown in FIGS. 2 and 3, a lighting fixture 20 is coupled to an architectural surface structure such as a wall 22. The wall 22 may be constructed from any material. In the illustrated embodiment, a gap 24 is formed in the wall 22 and is bordered by wall portions 22A, 22B. The gap 24 may have virtually any shape including, but not limited to, a rectangle, polygon, curve, oval, or circle. In an exemplary embodiment, the wall 22 is constructed from one or more drywall sheets arranged on a conventional stud frame, and the gap 24 is created by removing a portion or portions from the one or more drywall sheets. Alternatively, the lighting fixture 20 may first be installed on the studs and the wall may be added later. In other embodiments, the wall 22 may be constructed of wallboard, lathing for plaster, wood, or any other material used to construct an architectural surface.

The lighting fixture 20 includes a base plate 30 that forms a rear or base of the fixture. In the illustrated embodiment, the base plate 30 spans a longitudinal length of the fixture and extends in opposite lateral directions to partially overlie the wall portions 22A, 22B. The base plate 30 may include pre-drilled holes 32 sized to accept fasteners for attaching the base plate 30 to the wall 22. The base plate 30 is preferably constructed of a material suitable for supporting the components of the lighting fixture 20 and the light source. It is further preferable to use material that can act as a heat sink to maintain the thermal performance of the light source. Two exemplary materials exhibiting these properties are sheet metal and aluminum. The base plate 30 may further include heat fins projecting rearward to improve heat dissipation. Additionally, the base plate 30 may be coated with an intumescent paint to provide a fire-rated assembly to meet construction and/or fire code requirements. The intumescent coating can be applied on the front surface, rear surface, or both the front and rear surfaces of the base plate 30. The base plate 30 further may be formed without holes for applications requiring air tight construction, thereby to stop airflow from conditioned to unconditioned spaces.

First and second mounting brackets 34A, 34B are coupled to the base plate 30. Each mounting bracket 34A, 34B includes a front panel 36, a side wall 38, and a rear panel 40 (FIG. 3). An exterior surface 37 of the front panel 36 may be formed with grooves 39 for receiving drywall compound, plaster, or similar material commonly applied to architectural surfaces. An inner terminal edge 42 of the front panel 36 may include a lip 44 which defines a suitable depth for the drywall compound over the front panel 36, thereby to conceal the mounting brackets 34A, 34B. While the inner terminal edges 42 are illustrated in FIG. 3 as being substantially linear and oriented parallel to one another, it will be appreciated that the edges 42 may have a curved or otherwise non-linear shape and may be oriented non-parallel with respect to each other. An outer terminal edge 46 of the front panel partially overlies an associated wall portion 22A, 22B. The portion of the front panel 36 located near the outer terminal edge 46 may gradually thin so that a front surface slopes toward the wall 22, thereby to facilitate a substantially continuous appearance once mud or plaster is applied. The front surfaces of the front panels 36 may further include grooves 39 for improving adherence of mud or plaster thereto. The grooves may be spaced in a particular pattern that indicates to the installer where screws may be used to attach the brackets 34A, 34B to the wall 22.

While the base plate 30 and brackets 34A, 34B are illustrated in FIG. 3 as separate components that are assembled together, it will be appreciated that these elements may be formed together as a unitary structure.

Figure 7:
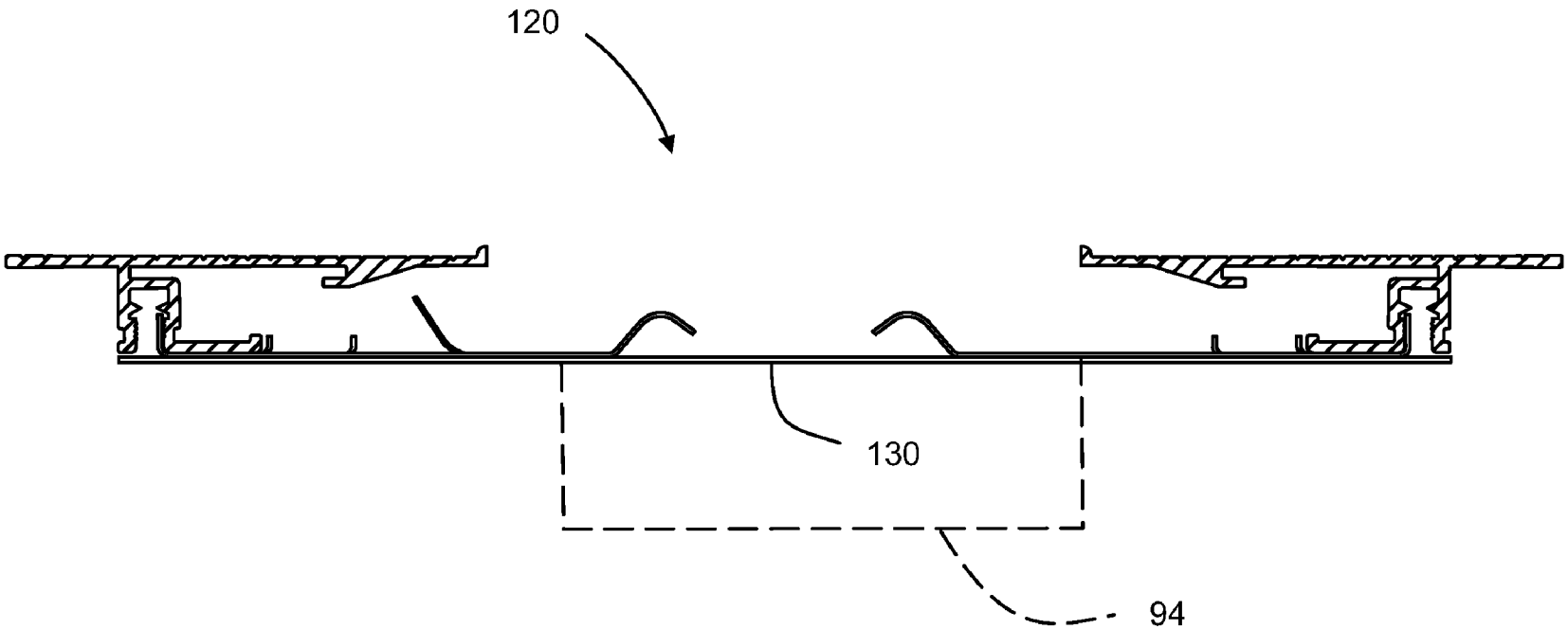
FIG. 7 is a cross-sectional view of an alternative embodiment of lighting fixture configured for use in a remodeling process.

The side wall 38 is configured to create sufficient spacing between the front and rear panels 36, 40 to receive a light source and between the front panel 36 and base plate 30 to receive the wall 22, as best shown in FIGS. 3 and 7. The inwardly extending portion of the front panel 36 and the base plate 30 form an edge receptacle 50. The front panel 36 and base plate 30 are separated by a spacing distance D so that the edge receptacle 50 has a depth sufficient to receive the light source. The outwardly extending portions of the front panel 36 and base plate 30 form an exterior socket 52 having a depth sufficient to receive a portion of the wall 22. As a result, the fixture 20 may have a thickness that is substantially the same as the wall 22, and therefore the fixture 20 may be installed without requiring reframing or other considerations associated with thicker, conventional light fixtures.

Figure 4:
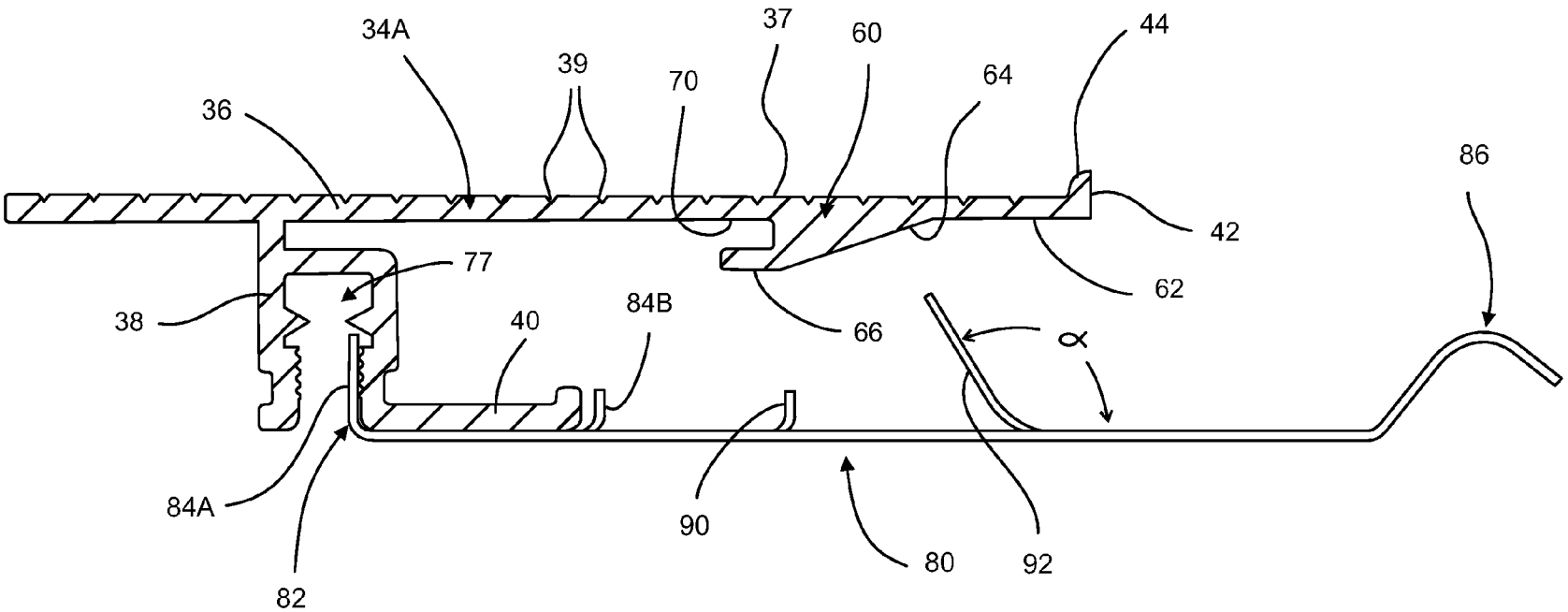
FIG. 4 is an enlarged cross-sectional view of a bracket and clamp used in the lighting fixture of FIG. 2.
Figure 6A:
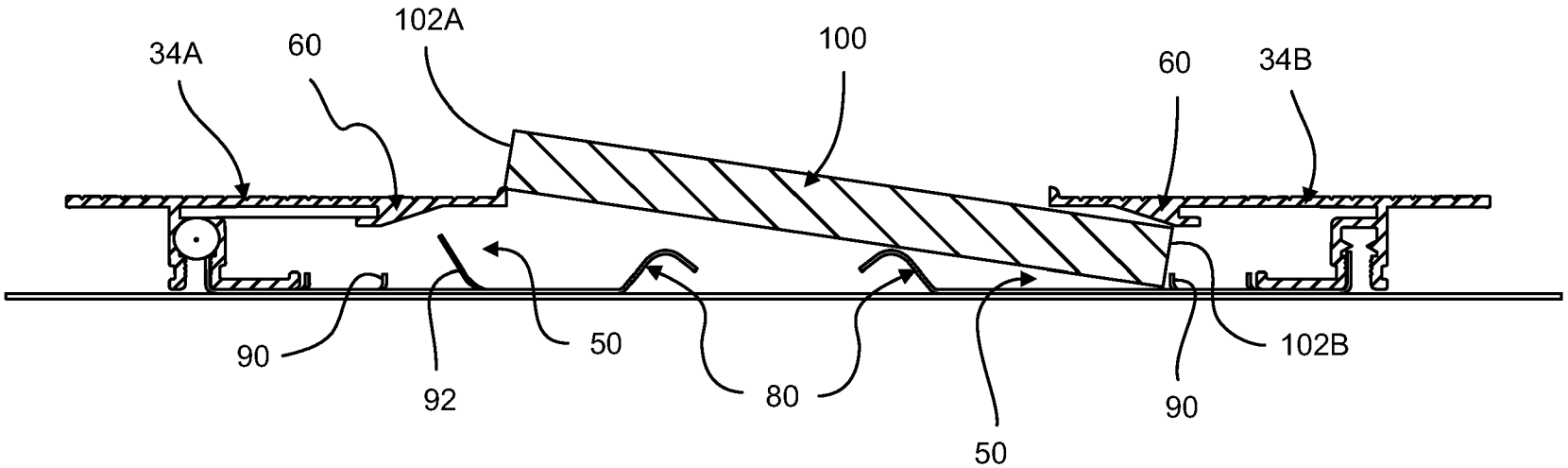
FIG. 6A is a side elevation view illustrating one end of a light panel inserted into a bracket of a lighting fixture.

A bearing structure 60 may be formed on an interior surface 62 of the front panel 36 to assist with insertion of the light source into the lighting fixture 20 and to center the light source within the lighting fixture 20. As best shown in FIGS. 3, 4, and 6A, the bearing structure 60 is illustrated as having an inclined bearing structure profile, with a base end 64 located nearer the inner terminal edge 42 of the front panel 36 and a projection end 66. The bearing structure 60 is configured to extend gradually farther into the edge receptacle 50 from the base end 64 to the projection end 66. In the illustrated embodiment, the bearing structure 60 defines an inclined surface 68 extending between the base and projection ends 64, 66.

The inclined bearing structure 60 described herein may assist with centering the light source within the lighting fixture 20. When the light source is biased into contact with the bearing structure 60 (as understood more fully below), the inclined surface 68 urges the engaged edge of the light source toward a center of the fixture 20. In addition, the bearing structure 60 provides a support for holding an edge of the light source during installation. As best understood in the context of a horizontally extending light system, a bottom edge of the light source may first be inserted into the edge receptacle 50 formed by the lower mounting bracket 34. The bearing structure 60 projects into the receptacle 50 to engage and support the lower edge of the light source, thereby preventing it from sliding too far into the mounting bracket 34. As a result, the bearing structure 60 assists with installation of the light source. It will be appreciated that the bearing structure 60 may be provided in alternative configurations, such as a corner, step, rounded/curved edge, or other abutment surface. Some of these alternative configurations may provide only one of the centering and edge support functions.

A slot 70 (FIG. 3) may also be formed on the interior surface 62 of the front panel 36 to receive a tab 72. The slot 70 and tab 72 allow multiple mounting brackets to be quickly and easily aligned, if needed.

The first and second mounting brackets 34A, 34B are oriented on the base plate 30 so that their respective edge receptacles 50 diametrically oppose each other, as illustrated in FIGS. 1 and 2. The mounting brackets 34A, 34B are further positioned on the base plate 30 so that their respective front panel inner terminal edges 42 are laterally spaced from one another. A lighting gap 74 spans the distance between the inner terminal edges 42 through which the light source will direct light.

An end cap 76 may be provided at the longitudinal ends of the fixture 20. As best shown in FIGS. 3 and 4, the mounting bracket side walls 38 may be configured with a fastener socket 77 for receiving a fastener 78, thereby to secure the end cap 76 to the brackets 34A, 34B.

Figure 5:
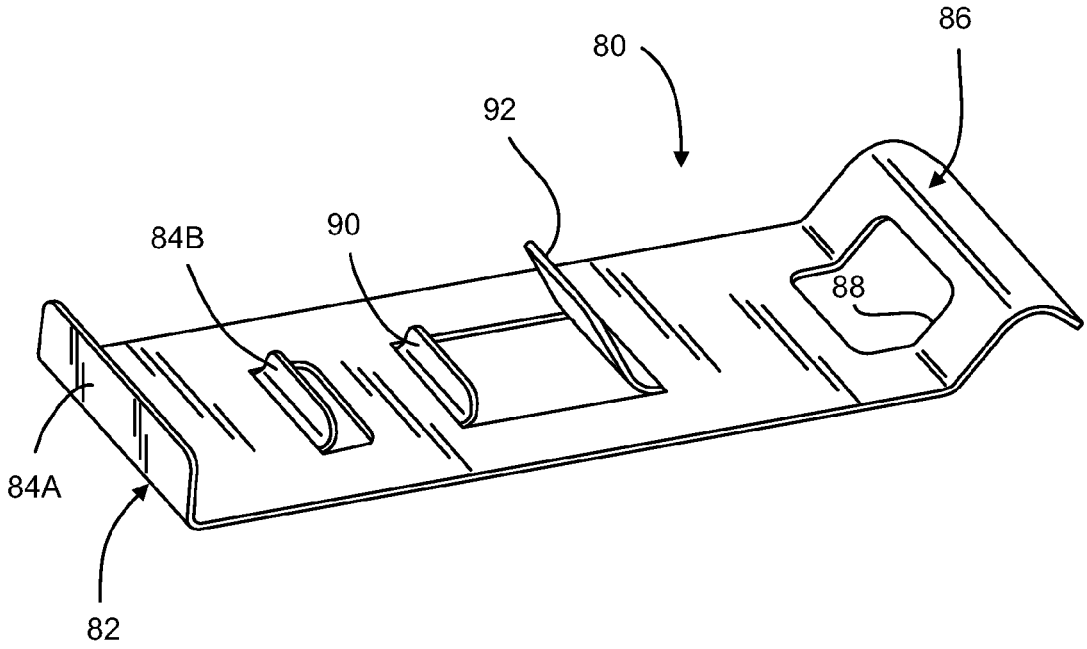
FIG. 5 is an enlarged perspective view of a clamp used in the lighting fixture of FIG. 2.

The lighting fixture 30 further includes one or more clamps 80 coupled to each mounting bracket 34A, 34B for holding a light source in the fixture. As used herein, the term "coupled" includes components that are either directly attached or attached through one or more intermediate components. As best shown in FIGS. 4 and 5, each clamp 80 is generally provided as a leaf spring. Accordingly, each clamp 80 includes a base end 82 coupled to the mounting bracket 34. In the illustrated embodiment, the base end 82 includes inner and outer tabs 84A, 84B configured to closely fit over the mounting bracket rear panel 40. A spring end 86 is provided opposite the base end 82. The spring end 86 is preferably aligned with the lighting gap 74 and configured to apply a biasing force in the direction of the mounting bracket front panel 36. To obtain the desired biasing force, an aperture 88 may be formed in the spring end 86. Each clamp 80 may further include a stop 90 extending into the edge receptacle 50 and sized to reliably engage an edge of the light source as it is inserted the mounting bracket 34, thereby to prevent the light source from sliding too far into the receptacle 50.

Still further, each clamp 80 may include a spring arm 92 for providing additional biasing force and for centering the light source within the fixture 20. As best shown in FIG. 4, the spring arm 92 extends at an oblique angle a from a body of the clamp 80. Accordingly, the spring arm 92 applies a biasing force directed not only toward the front panel 40 but also toward a center of the fixture 20. The light source, when engaged at opposite lateral portions by such spring arms 92, is automatically centered with respect to the lighting gap 74.

A sufficient number of clamps are coupled to each bracket 34 to ensure that the light source is securely retained within the lighting fixture 20. In the embodiment illustrated in FIG. 2, a single clamp 80 is attached to each bracket 34A, 34B. In other embodiments, however, more than one clamp 80 may be attached to each bracket 34A, 34B. Various factors, such as the longitudinal length of the fixture 20, size and weight of the light source, size of the lighting gap, and orientation of the lighting system (i.e., extending horizontally or vertically along a wall, extending across a ceiling, etc.), should be considered when selecting the number of clamps 80 to use.

While the spring end 86, stop 90, and spring arm 92 are described above as integrally provided in a single clamp 80, it will be appreciated that these components may be provided as separate structures.

An alternative embodiment of a lighting fixture 120 is illustrated in FIG. 7 that is particularly suited for renovation or remodeling projects. The lighting fixture 120 is substantially similar to the lighting fixture 20 described above, but has a modified base plate 130. More specifically, the lateral edges of the base plate 130 do not extend outwardly to overlie portions of the wall 22 but instead terminate at the mounting bracket side wall 38. This allows the assembled lighting fixture 120 to be inserted into the wall 22 from the front without requiring access to the space behind the wall 22. In this embodiment, fasteners may be used to attach the mounting bracket front panel 36 to the exterior surface of the wall 22. The fasteners may be concealed by applying drywall compound over the front panel 36.

Figure 6B:
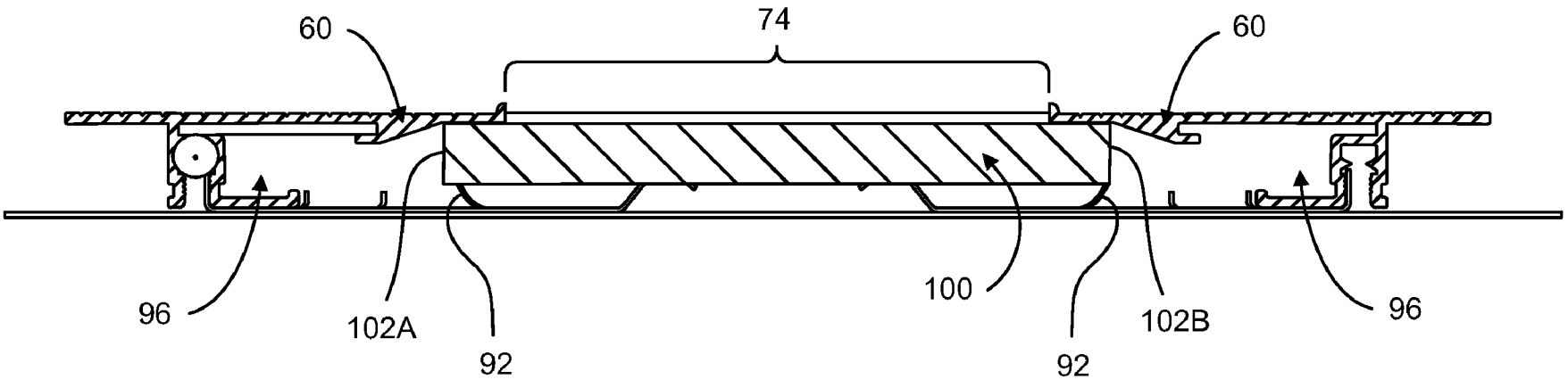
FIG. 6B is a side elevation view illustrating both ends of a light panel inserted into the brackets of a lighting fixture.

The lighting fixtures described herein allow light sources to be quickly and easily inserted and removed. As shown in FIGS. 6A and 6B, a light source such as an LED light panel 100 may be provided having lateral edges 102A, 102B sized for insertion into the fixture 20. In the illustrated embodiment, the LED light panel has a substantially rectangular cross-section and is configured as an elongate strip. As noted above, the lighting fixtures may be used with light sources having other configurations and/or cross-sections. The light source may further have other distributions from spot to flood or lambertian, as well as asymmetric for wall wash applications.

FIGS. 6A and 6B also illustrate how a light panel 100 may be installed into a lighting fixture, such as the lighting fixture 20. A first edge 102B of the light panel 100 may be inserted into the edge receptacle 50 defined by mounting bracket 34B. The light panel edge 102B is advanced until it engages the stop 90. During this step, the bearing structure 60 may guide the edge 102B toward the clamp 80 to ensure that it engages the stop 90. The edge receptacle 50 is sized and the stop 90 is located such that, with the first edge 102B fully inserted, the second edge 102A of the light panel has clearance to be rotated into alignment with the edge receptacle 50 of the other mounting bracket 34A. The light panel 100 may then be repositioned so that the edge 102A is inserted into the edge receptacle 50 of the mounting bracket 34A. When the user subsequently releases the light panel 100, the spring arms 92 and bearing structures 60 engage the opposite edges 102A, 102B to secure the light panel 100 in place. The spring arms 92 and bearing structure 60 may also bias the light panel 100 to a centered position with respect to the lighting gap 74, as illustrated in FIG. 6B.

The lighting systems described herein also allow components in addition to the light source to be inserted into the edge receptacles 50. For example, a filter, lens, or other optical component may be needed to achieve a desired lighting effect. In the embodiment illustrated in FIGS. 2-5, the lens may be slid in place, while other embodiments may use snap-in or other types of lenses. The lens may be colored or configured to produce a desired light distribution, such as spot, flood, or asymmetric. Such components may be formed of relatively thin layers of paper, acrylic ribbon, or other material. These components may be simply and easily assembled with the lighting fixture by positioning them as desired over the light source and inserting them in the same manner as the light source, either individually or in combination with the light source. The clamps 80 will provide a sufficient biasing force to retain the additional components in the desired position.

The ease with which components are inserted into and removed from the mounting brackets 34 allows a temporary support member to be used as the lighting fixture is attached to the architectural surface. The temporary support member may be sized and configured to closely fit within the edge receptacles 50, and may be formed of a durable material such as cardboard or wood. Prior to attachment to the architectural surface, the temporary support member may be inserted into the edge receptacles 50. The support member prevents drywall compound, plaster, or other construction materials from entering the fixture and provides additional resistance against bending or other undesirable forces as the lighting fixture is manipulated into place and attached to the architectural surface. Once the lighting fixture is in place, the temporary support panel is removed and the light source may be inserted.

If needed, a driver, power supply, or current control ballast 94 (FIG. 7) may be provided to power the light source. In the illustrated embodiment, the ballast 94 is disposed in a housing that is attached to a rear of the base plate 130. The housing may be positioned to occupy unused space behind the architectural surface, such as the space between adjacent studs. Alternatively, the housing may be positioned remotely from the base plate 130.

The mounting brackets 34A, 34B may be further configured to provide a wireway for the light source. As best shown in FIG. 6B, each mounting bracket 34 includes a side space 96 sized to receive one or more wires or connectors for connecting the light source to a power source. Accordingly, the wiring may be located laterally next to the light source rather than behind the light source, thereby helping to maintain the relatively small thickness of the fixture. The side space 96 may be provided on either or both mounting brackets 34A, 34B as needed.

While the brackets 34A, 34B may be configured to provide the wireway as noted above, the space provided behind the front panels 36 may be used for alternative or additional purposes. For example, the front panels 36 may intentionally overlap the edges of the light source 100 by a desired distance to conceal the peripheral edges of the light source 100. The edges of many light panels may be less bright or may create scallop patterns. The front panels 36 may extend over these areas so that the visible light is more uniform. If, however, a light source is used that generates uniform light entirely to its edges, then the front panels need not extend over the edges of the light source and the light source may have the same width as the aperture between the inner terminal edges of the front panels.

Figure 8:
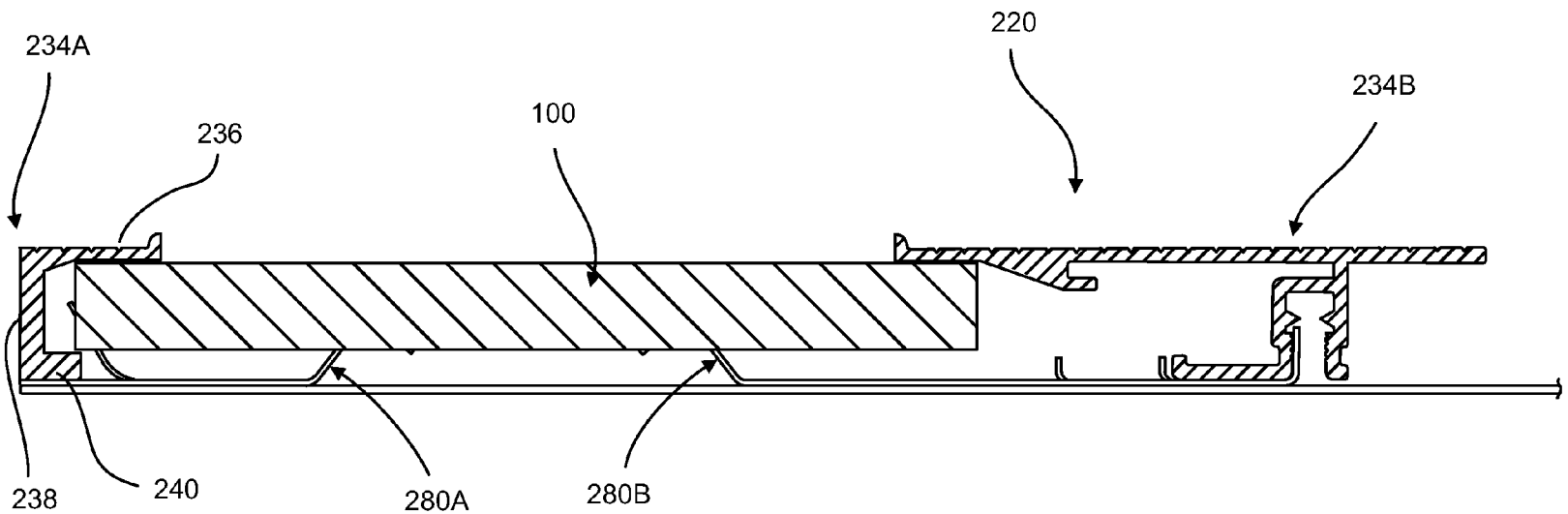
FIG. 8 is a cross-sectional view of a further alternative embodiment of a lighting system configured for use along an outer periphery of an architectural surface.

A further embodiment of a lighting fixture 220 is illustrated in FIG. 8. The lighting fixture 220 is particularly suited for use along a periphery of an architectural surface, such as the lighting system 12K illustrated in FIG. 1. The periphery of an architectural surface is often bordered by another surface that extends along a different plane. In certain applications, therefore, one side of the lighting fixture may have limited available space in which to extend.

The lighting fixture 220 addresses the limited available space issue by providing a low profile mounting bracket 234A. The mounting bracket 234A includes a front panel 236, a side wall 238, and a rear panel 240. Unlike the previous exemplary embodiments, the front panel 236 does not extend outwardly but instead terminates at the side wall 238. The lighting fixture 220 also includes a back plate 230 that terminates at the side wall 238 of the mounting bracket 234A and a clamp 280A modified to fit the mounting bracket 234A. The other mounting bracket 234B and clamp 280B may be provided substantially identical to those described above.

An alternative lighting system 300 is illustrated in FIGS. 9-13 in which a light source 301 is biased toward a base plate 302. The system 300 is coupled to an architectural structure such as a wall 304, and includes mounting brackets 306A, 306B and clamps 308 that are different from the previous embodiments.

Figure 11:
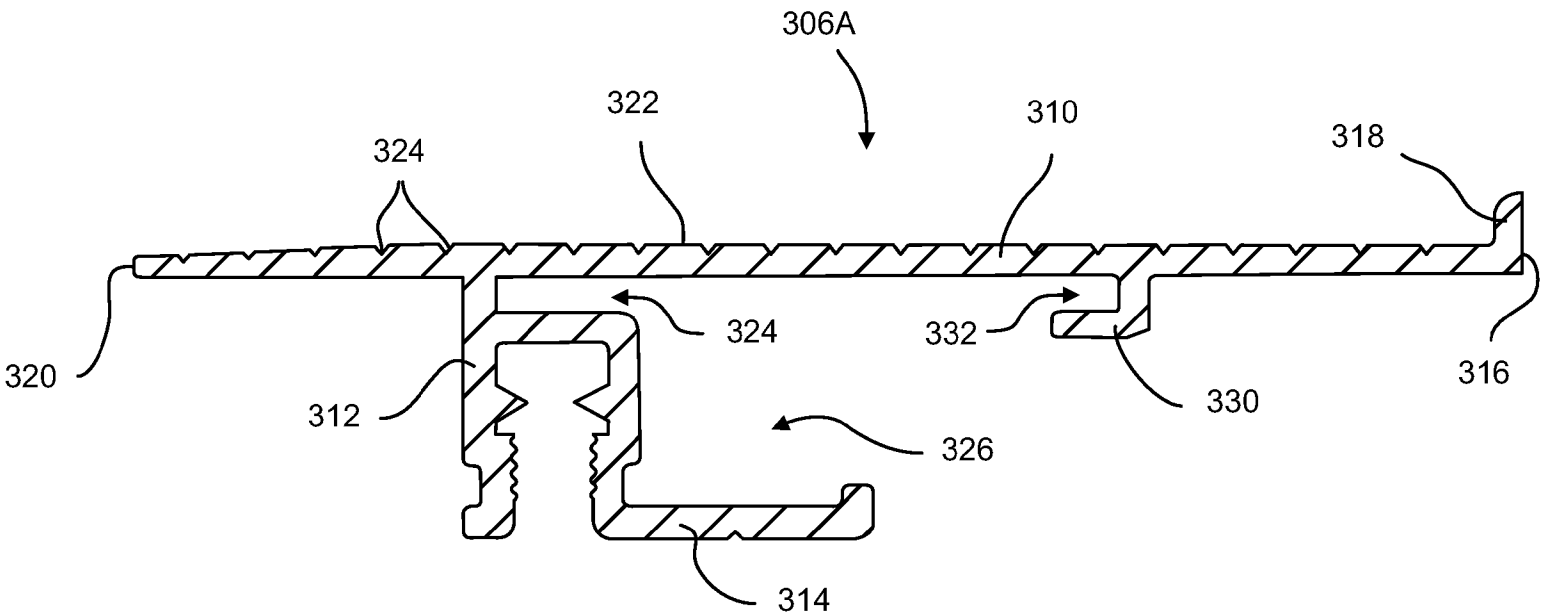
FIG. 11 is an enlarged plan view of a bracket used in the lighting system of FIG. 9.

Each mounting bracket 306A, 306B includes a front panel 310, a side wall 312, and a rear panel 314 (FIG. 11). An inner terminal edge 316 of the front panel 310 may include a lip 318 which defines a suitable depth at which drywall compound or plaster may be applied over the front panel 310. The front panel 310 further has an outer terminal edge 320. A front surface 322 of the front panel 310 may gradually taper rearward so that the thickness of the front panel 310 is greater at the inner terminal edge 316 than at the outer terminal edge 320, as best shown in FIG. 11. Grooves 324 may be formed in the front surface 322 to improve adherence of the drywall compound or plaster to the front panel 310. The rear panel 314 is coupled to the base plate 302, and the side wall 312 is sized to create sufficient spacing between the front and rear panels 310, 314 to receive light source 301. The rear panel 314 may also define a wireway space 326 for accommodating electrical wires 328 connected to the light source 301. An arm 330 extends from a rear surface of the front panel 310 to define a recess 332. A second recess 334 is located between the front panel 310 and a portion of the side wall 312. The first and second recesses 332, 334 are aligned and sized to receive edges of a tab (not shown) used to connect adjacent mounting brackets, if needed.

Figure 9:
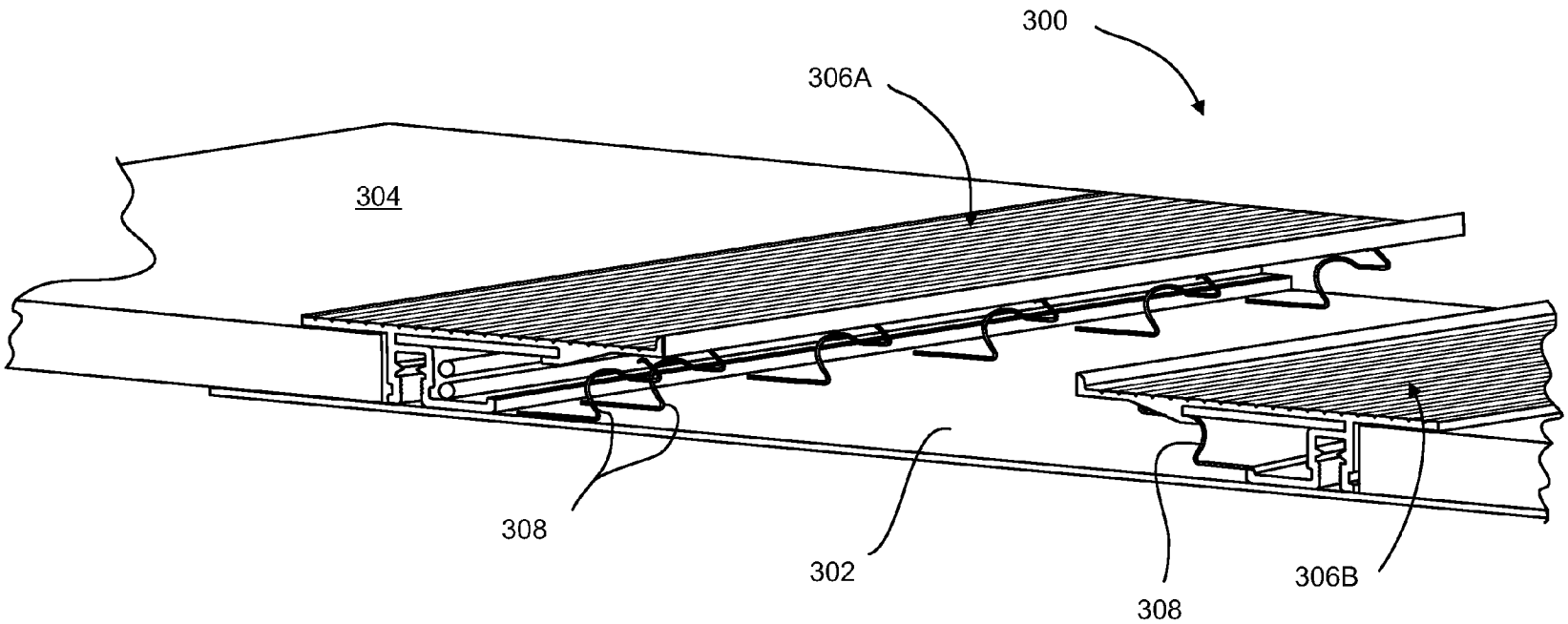
FIG. 9 is a perspective view of an alternative lighting fixture.
Figure 10:
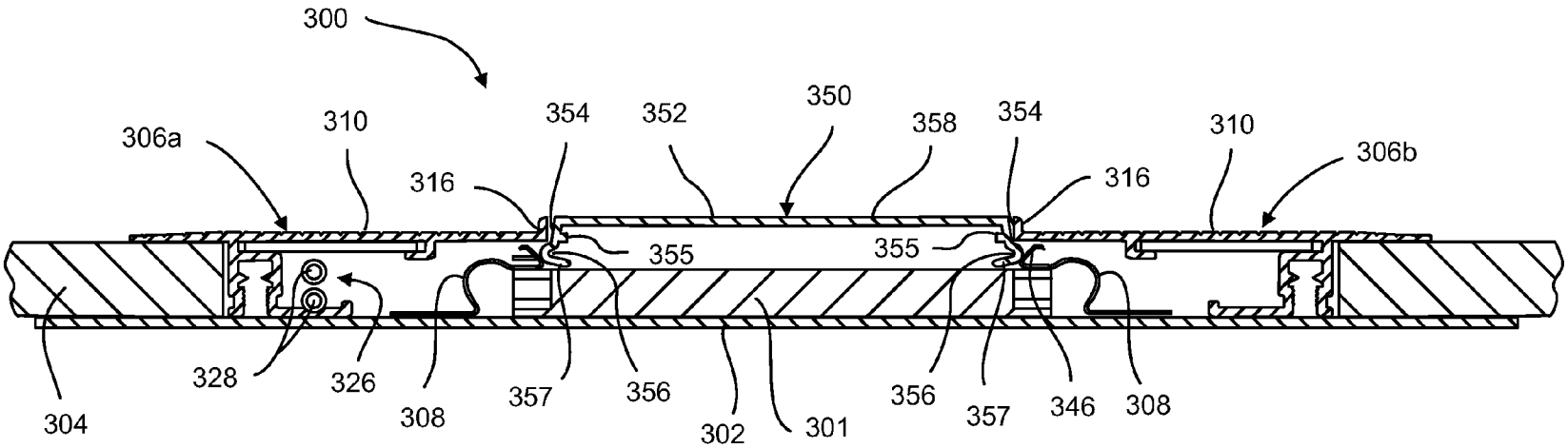
FIG. 10 is a side elevation view, in cross-section, of the lighting fixture of FIG. 9 with installed light source and filter.
Figure 12:
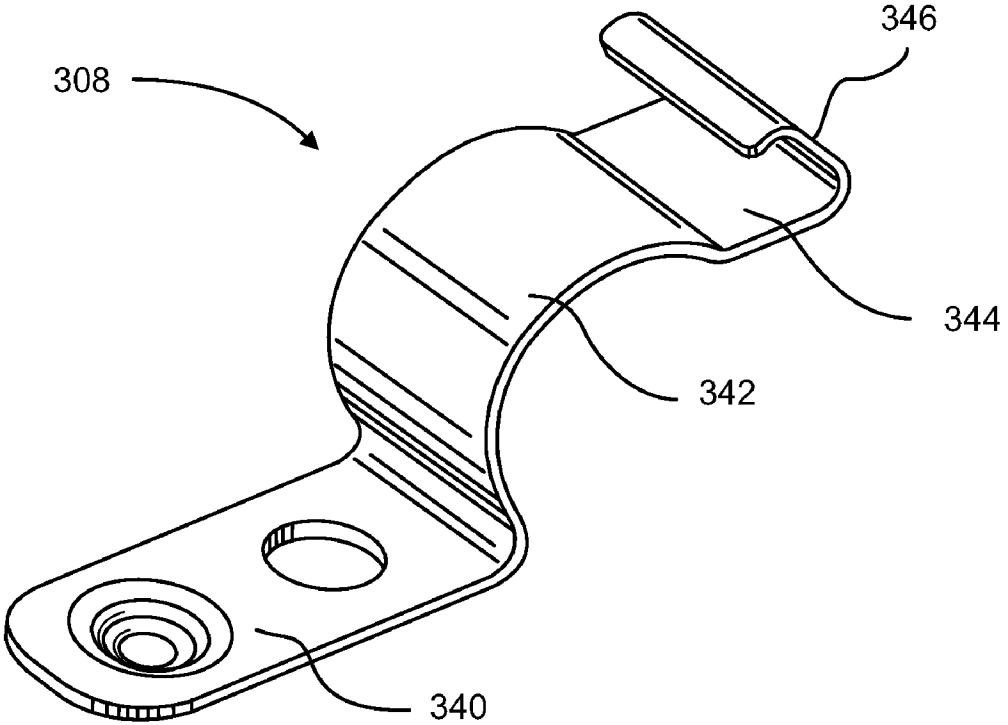
FIG. 12 is an enlarged perspective view of a clamp used in the lighting system of FIG. 9.

Multiple clamps 308 may be coupled to the base plate 302 for securing the light source 301 in place. As best shown in FIG. 12, each clamp 308 may include a base end 340 adapted for attachment to the base plate 302. A spring section 342 of the clamp 302 may be arcuate and sized to receive an edge of the light source 301. A grip portion 344 is configured to engage a surface of the light source 301, and the spring section 342 may be configured to apply a biasing force toward the base plate 302 when the light source 301 is inserted, as best shown in FIG. 10. A clip section 346 is provided to engage a portion of a lens, cover, or other optional structure inserted over the light source, as understood more fully below. The clip section 346 may be angled as shown to provide a biasing force toward the front panel 310, as well as to accommodate various thicknesses of the optional overlying structure. As shown in FIG. 9, multiple clamps 308 may be spaced along the base plate 302 to secure the light source 301 in place.

An overlying structure, such as a lens 350, is shown in FIG. 10. The lens 350 includes a main panel 352 and opposed, flexible side walls 354. Each side wall 354 includes a projection 356. During installation, the side walls 354 may be flexed inwardly so that the projections 356 may slide past the inner terminal edges 316 of the bracket front panels 310. Once the projections 356 are past the terminal edges 316, they may resume an at least partially expanded state to retain the lens 350 within the brackets 306A, 306B. The clamp clip sections 346 may also engage a portion of the side walls 354 to further secure the lens 350 in place. Portions of the lens side walls 354 and projections 356 may be cut away to facilitate rolling of the lens for shipping long pieces, or to allow various lens intersections.

Figure 13:
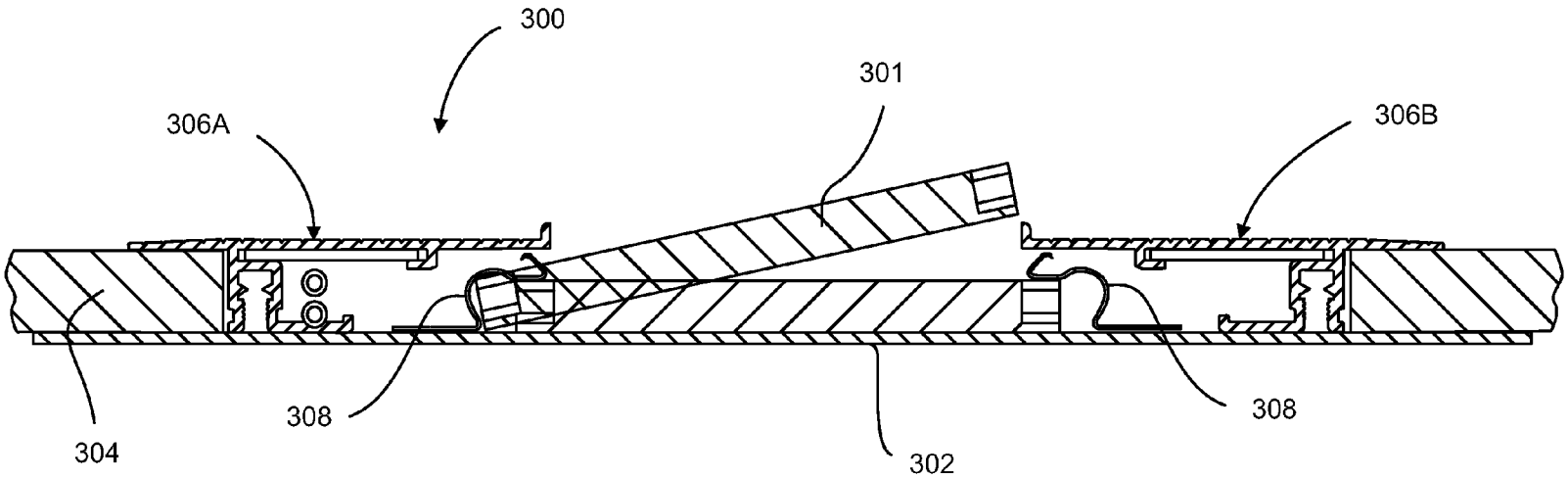
FIG. 13 is a side elevation view, in cross-section, of a light source being installed into the lighting system of FIG. 9.

Installation of the light source 301 into the brackets 306A, 306B is best illustrated with reference to FIG. 13. A first lateral edge of the light source 301 may be inserted into one of the clamps 308. The opposite lateral edge of the light source 301 may then be rotated past the bracket 306B until it is adjacent the base plate 302 and aligned with the other clamp 308. The light source 301 may then be laterally translated so that both clamps 308 engage and hold the light source 301 in place. By holding the light source 301 against the back plate 302, the lighting system 300 advantageously increases the amount of heat dissipated through the base plate 302.

The lens 350 may then be snap-fit into place as shown in FIG. 10, with the projections 356 pinched between the clamp clip section 346 and a rear surface of the front panel 310. An outer surface 358 of the lens 350 may be substantially flush with the wall 22 to provide a clean, continuous transition between the wall and light system.

The lens 350 illustrated in FIG. 10 may be of any style and type known in the art. The lens 350 may include an accessory filter (such as a decorative stencil, a color gel, or other diffusing media) disposed behind the outer surface 358. The lens 350 may include inwardly extending flanges 355 to hold such lens accessories in place. The lens 350 further may be formed with various profiles to obtain asymmetric or different distributions and brightness. The side walls 354 may include an extended, inwardly projecting lip 357 to provide additional diffusion, thereby avoiding hot spots and/or scallops that may emanate from the light source 301, which may be a particular issue with some LEDs. The lens 350 may be cut and mitered in the field for precise fit and finish. The side walls 354 further may be oriented at a slight angle as shown to permit insertion of a tool such as a putty knife between the lens 350 and brackets 306A, 306B, thereby to retract the projections 356 to facilitate removal of the lens 350.

Figure 14:
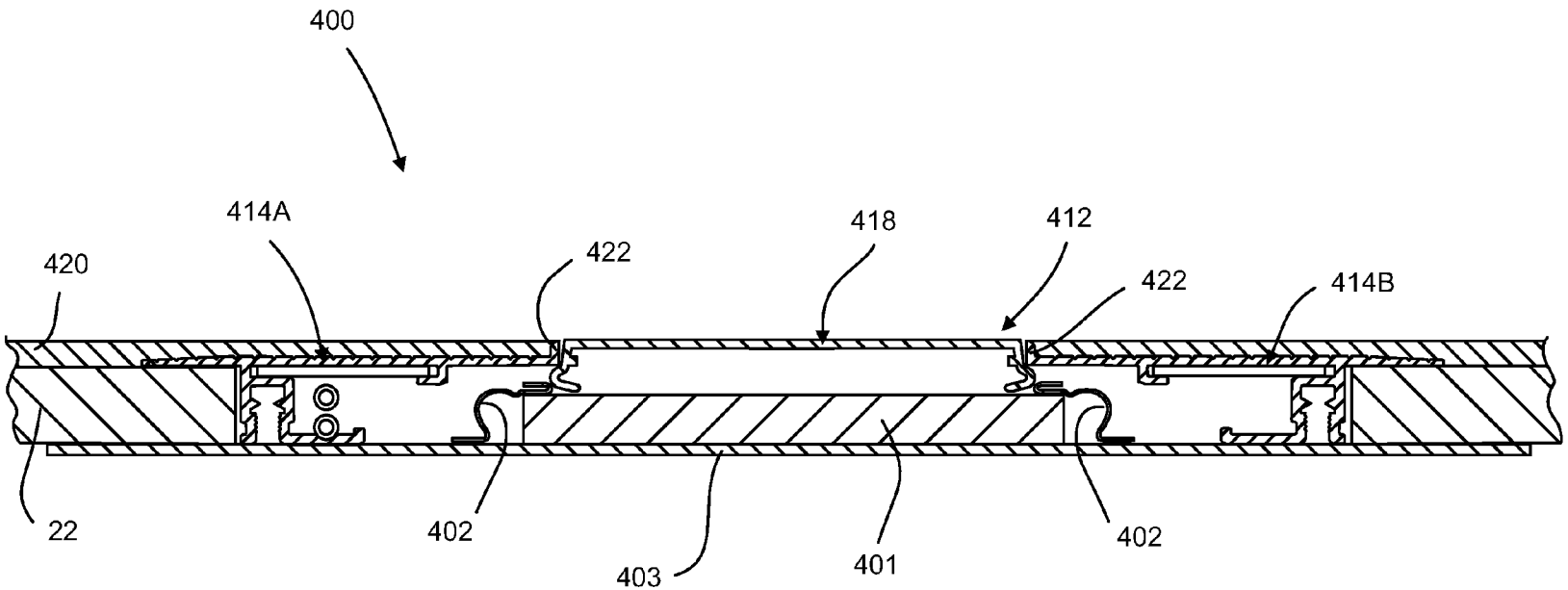
FIG. 14 is a side elevation view, in cross-section, of a further embodiment of a lighting system.
Figure 15:
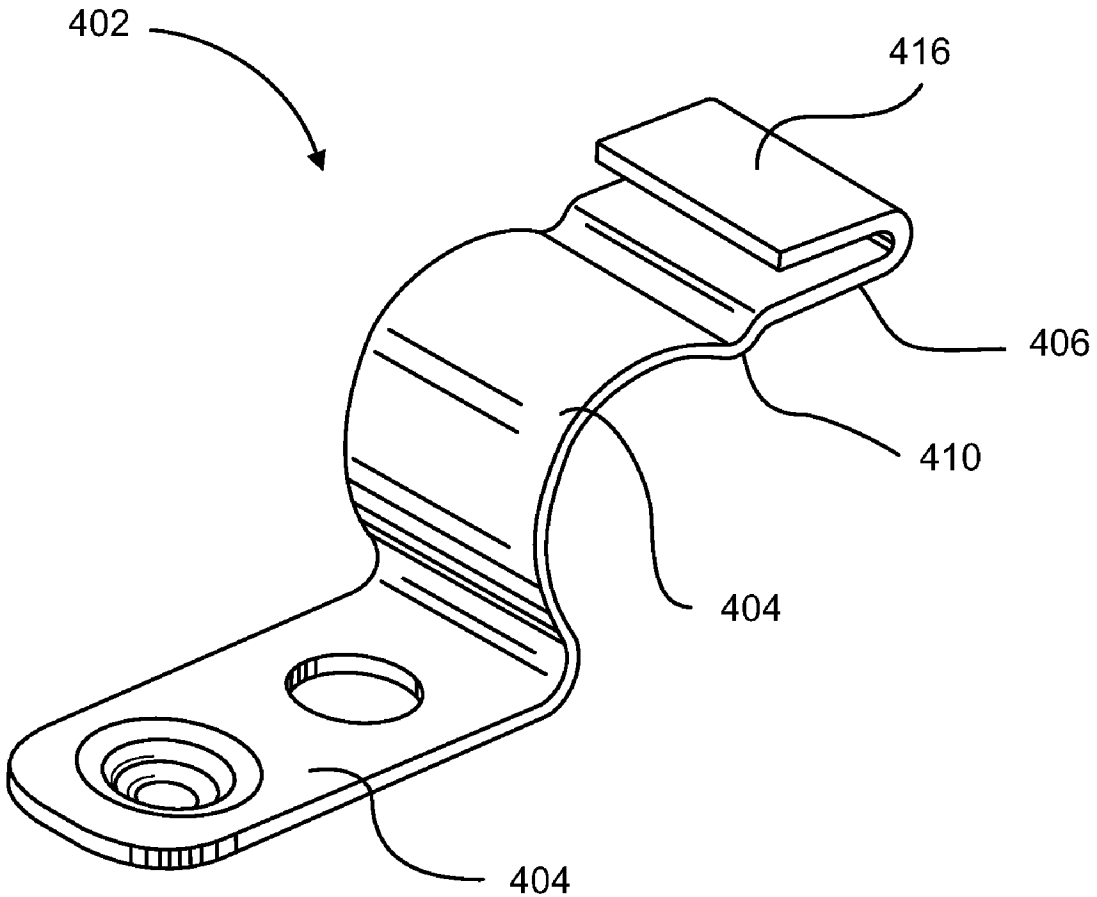
FIG. 15 is an enlarged perspective view of a clamp used in the lighting system of FIG. 14.
Figure 16:
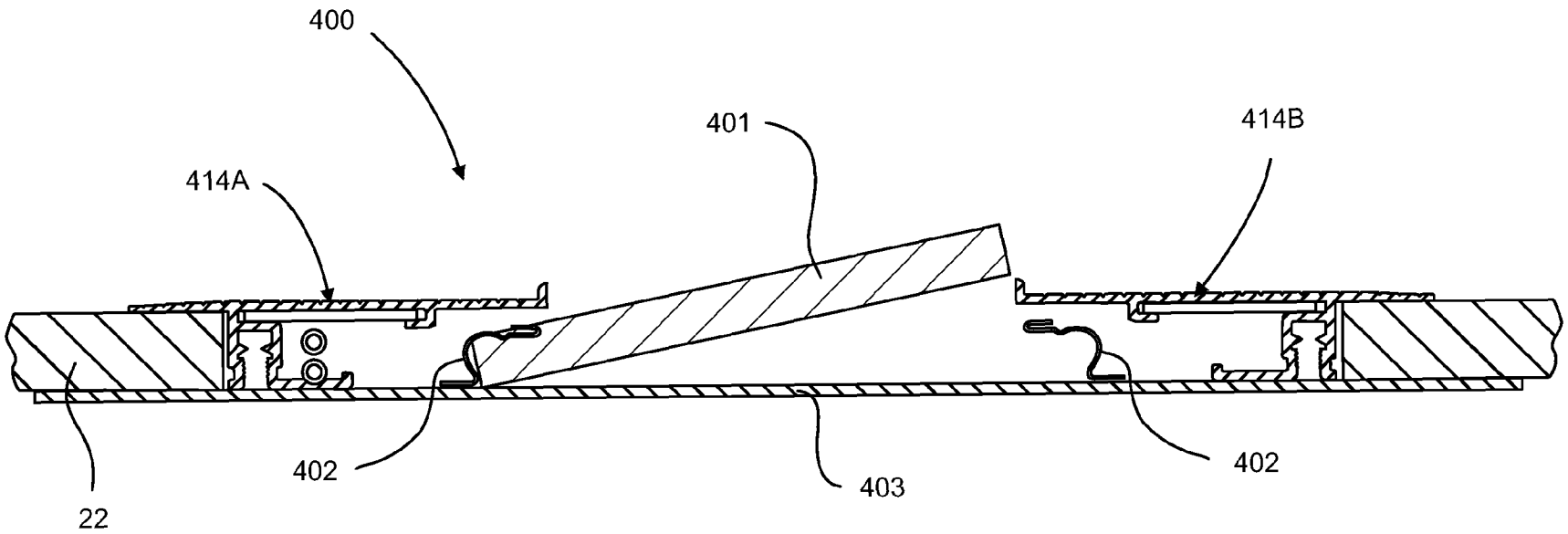
FIG. 16 is a side elevation view, in cross-section, of a light source being installed into the lighting system of FIG. 14.

A further alternative embodiment of a lighting system 400 is illustrated in FIGS. 14-16. The lighting system 400 is substantially similar to the system 300 discussed above, but uses a different clamp 402. As best shown in FIG. 15, each clamp 402 may include a base end 404 adapted for attachment to a base plate 403. A spring section 404 of the clamp 402 may be arcuate and sized to receive an edge of the light source 401. A grip portion 406 is configured to engage a surface of a light source 408, and the spring section 342 may be configured to apply a biasing force toward the base plate 403 when the light source 401 is inserted, as best shown in FIG. 16. A centering nub 410 is disposed between the spring section 404 and the grip portion 406. The centering nub 410 projects rearward toward the base plate 403 to provide a biasing force that centers the light source 401 with respect to a gap 412 defined between brackets 414A, 414B. A clip section 416 is provided to engage a portion of a lens, cover, or other optional structure inserted over the light source. FIG. 14 illustrates a snap-fit lens 418, identical to the lens 350 described above, held securely in place between the clip sections 416 of the clamps 402 and the brackets 414A, 414B. FIG. 14 also illustrates a cover layer 420 of material, such as drywall compound or plaster, applied over the brackets 414A, 414B and wall 22 to provide a continuous transition. Lips 422 extending outwardly from the brackets 414A, 414B provide a reference depth at which the cover layer 420 may be applied.

Figure 17:
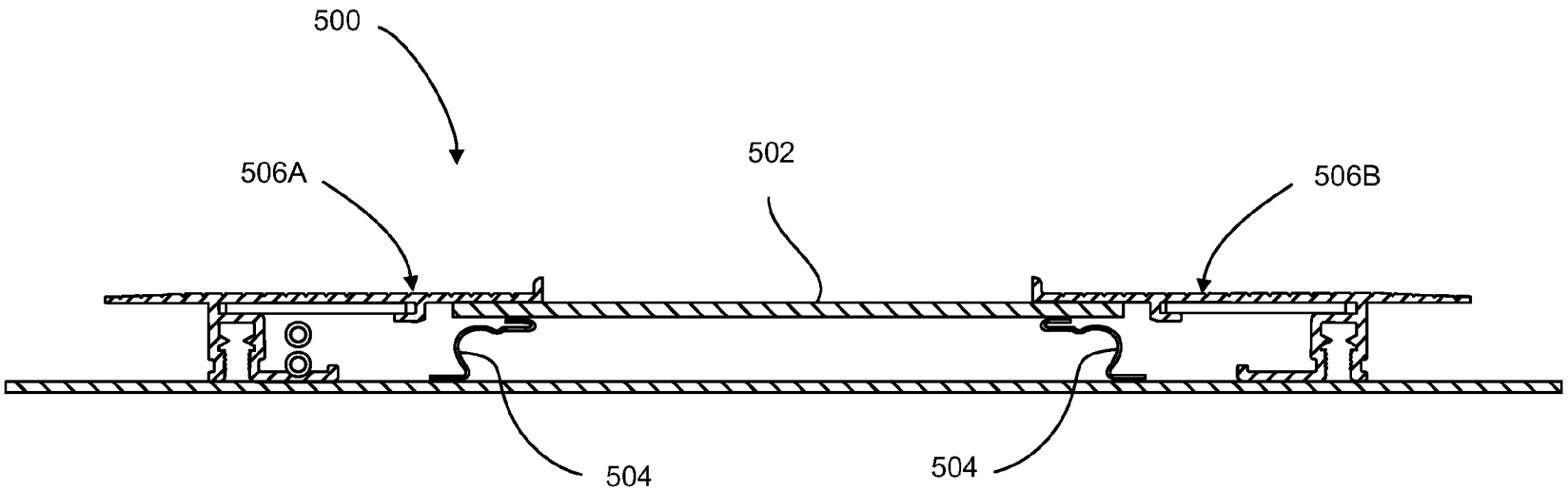
FIG. 17 is a side elevation view of the lighting system of FIG. 14 with an alternative lens.

FIG. 17 illustrates a lighting system 500 nearly identical to the system 400 of FIGS. 14-16, except with an alternative lens 502. Instead of having flexible side walls, the lens 502 is a planar sheet of material having a thickness sufficient to be pinched between clamps 504 and brackets 506A, 506B.

Figure 18:
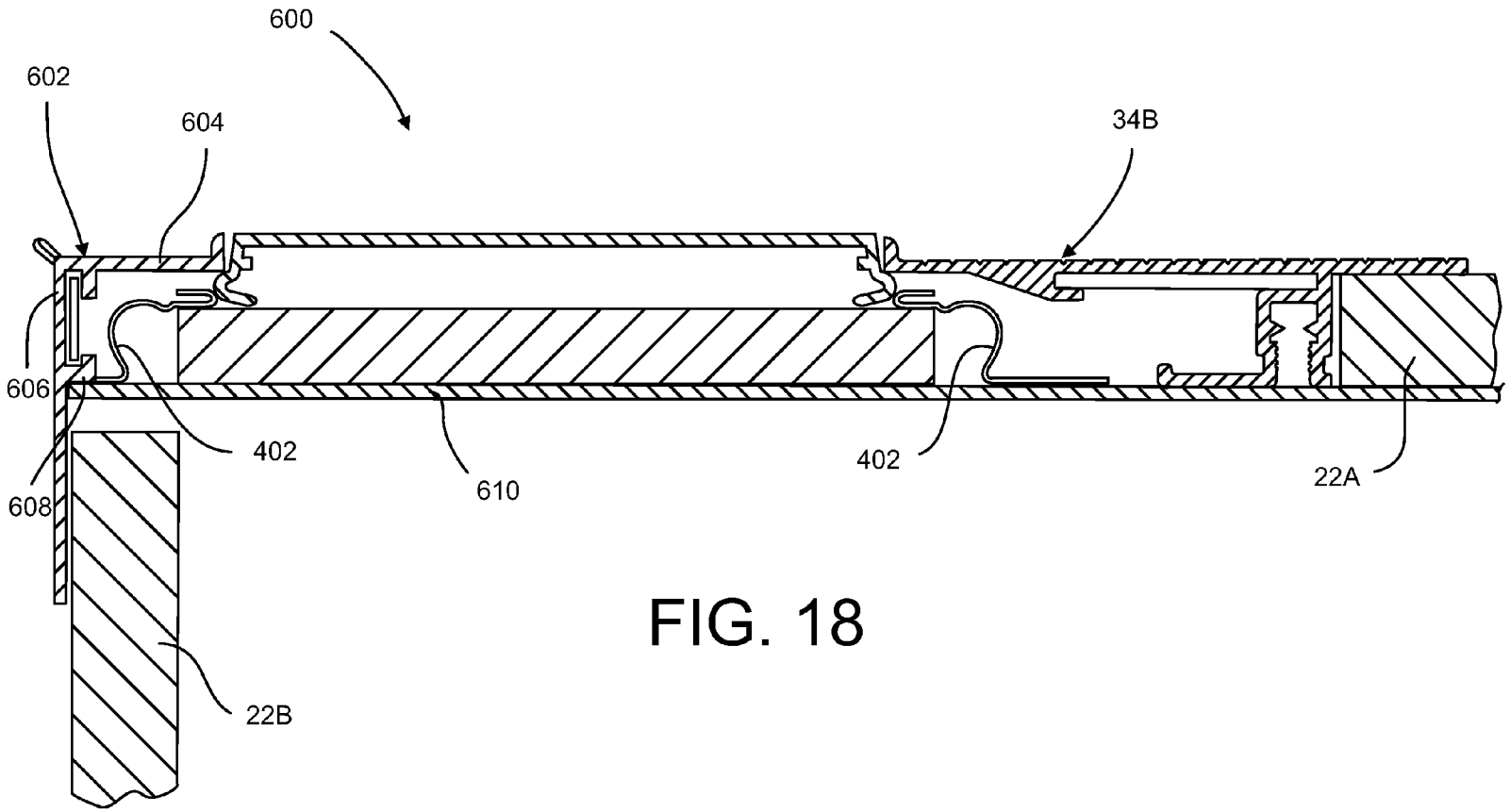
FIG. 18 is a side elevation view, in cross-section, of an alternative embodiment of a lighting system for an outside corner of an architectural structure.

FIG. 18 illustrates a lighting system 600 having an outer corner bracket 602, which may be suitable for use on an architectural structure forming an outside edge. The system 600 includes the clamps 402 and one bracket 34B as described above. The outer corner bracket 602, however, may join wall sections that extend at an angle to one another, such as perpendicular wall sections 22*a*, 22*b* shown in FIG. 18. In the illustrated embodiment, the outer corner bracket 602 includes a first front panel 604, a second front panel 606, and an intermediate panel 608. The intermediate panel 608 may be coupled to a base plate 610. The first front panel 604 may include a lip 612. A corner bead 614 may extend outwardly from the corner formed between the first and second front panels 604, 606. The lip 612 and corner bead 614 provide a reference depth at which drywall compound or plaster may be applied over the bracket 602.

Figure 19:
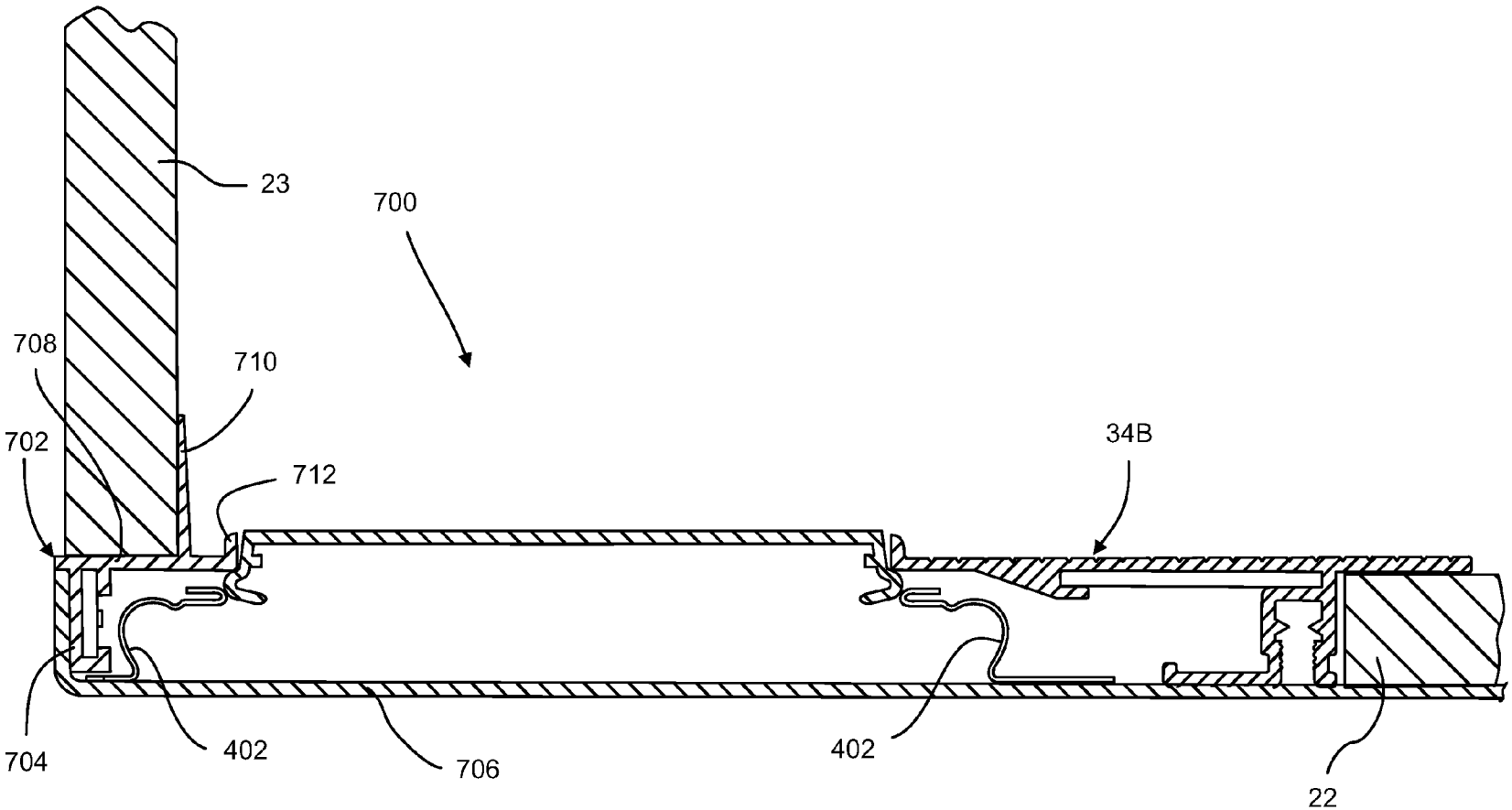
FIG. 19 is a side elevation view, in cross-section, of a lighting system for an inside corner of an architectural structure.

FIG. 19 illustrates a lighting system 700 having an inner corner bracket 702 adapted for use at an inside edge of an architectural structure. The system 700 includes clamps 402 and one bracket 34B as described above. The corner bracket 702, however, is modified for attachment to a wall 23 that is not substantially planar with the wall 22 to which the bracket 34B is attached. In the illustrated embodiment, wall 23 is substantially perpendicular to the wall 22 to form an inside corner. The corner bracket 702 includes a base wall 704 coupled to a base plate 706, an intermediate wall 708, and a front panel 710 coupled to the wall 23. The intermediate wall 710 may include a lip 712 providing a reference depth for a cover layer of material (not shown).

Figure 20:
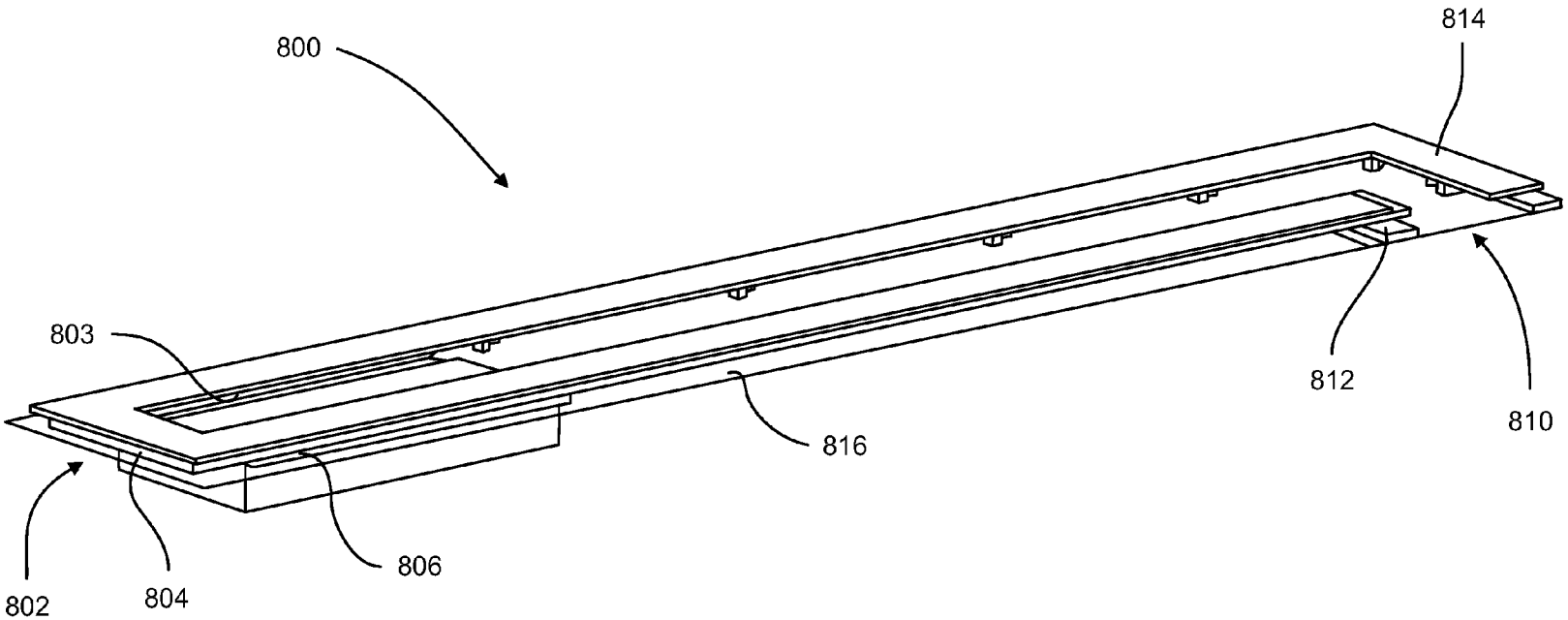
FIG. 20 is a perspective view of a lighting system having mitered corners.

FIG. 20 illustrates a further alternative embodiment of a lighting system 800. The lighting system 800 includes a closed end 802 formed by mitered brackets 803, 804, and 806. A closed end may be used when an end of the fixture terminates at a central part of the wall (such as light system 12A in FIG. 1) rather than at a wall edge (such as light system 12B in FIG. 1). The lighting system 800 further includes an open end 810 adapted for connection to an additional portion of the lighting system 800 (not shown). The open end 810 includes brackets 812, 814 that are positioned to mate with components on the other fixture piece (not shown). The brackets 812, 814 may be mounted on a common base plate 816 prior to reaching the installation site, thereby minimizing expensive field adjustments. This is particularly advantageous for more complex shaped lighting systems, such as lighting system 12E shown in FIG. 1.

While the lighting fixture has been illustrated for use in walls or ceilings, it may also be used in various other structures. For example, the lighting fixture may be used in floors, stairs, interior cabs, risers, under cabinets, showers, behind glass tiles, and behind mirror lights, among other locations. Use in a floor requires additional considerations, such as a waterproof barrier for the light source. As noted above, however, the lighting fixtures disclosed herein permit quick and easy insertion of additional components, and therefore are well suited for flooring applications. Furthermore, the mounting brackets, such as brackets 34A, 34B, may be modified to have taller lips 44 to accommodate the thicker materials typically used to create floor surfaces.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A lighting fixture for attachment to an architectural surface structure and adapted to hold a light source, the lighting fixture comprising:

a base plate;

first and second mounting brackets, each mounting bracket including a rear panel coupled to the base plate and a front panel joined to the rear panel by a side wall to define a receptacle between the front panel and the base plate, the receptacle having a depth defined by a spacing distance between the front panel and the base plate sufficient to receive an edge of the light source, each front panel further defining an inner terminal edge, the first and second mounting brackets being oriented such that the receptacles diametrically oppose one another, the first and second mounting brackets further being positioned such that the front panel inner terminal edges are laterally spaced from one another to define a lighting opening;

a first clamp disposed in the first mounting bracket receptacle, the first clamp including a base end coupled to the base plate, a grip portion configured to engage the light source, and a spring section disposed between the base end and the grip portion and sized to receive a first edge of the light source, the spring section being configured to bias the first edge of the light source toward the base plate; and a second clamp disposed in the second mount bracket receptacle, the second clamp including a base end coupled to the base plate, a grip portion configured to engage the light source, and a spring section disposed between the base end and the grip portion and sized to receive a second edge of the light source, the spring section being configured to bias the first edge of the light source toward the base plate.

2. The lighting fixture of claim 1, in which each of the first and second clamps further includes a clip section extending from a distal end of the grip portion.

3. The lighting fixture of claim 2, in which each of the first and second clamps further includes a centering nub disposed between the spring section and the grip portion.

4. The lighting fixture of claim 2, further comprising an overlying structure extending over the gap and having a first edge disposed between the first clamp clip section and the first bracket and a second edge disposed between the second clamp clip section and the second bracket.

5. The lighting fixture of claim 4, in which the overlying structure comprises a lens.

6. The lighting fixture of claim 4, in which the overlying structure includes an outer surface and the first and second clamps define front panel exterior surfaces, and in which the overlying structure front surface is substantially flush with the front panel exterior surfaces.

7. The lighting fixture of claim 4, in which the overlying structure includes rearward projecting sidewalls, and in which each sidewall includes an inwardly projecting lip.

8. The lighting fixture of claim 1, in which each of the first and second brackets includes an inner terminal edge and a forward extending lip projecting from the inner terminal edge.

9. The lighting fixture of claim 1, in which the first bracket further defines a wireway spaced laterally outwardly from the first clamp.

10. The lighting fixture of claim 1, in which at least a portion of the base plate is coated with intumescent paint.

11. The lighting fixture of claim 1, in which the base plate and first and second brackets are initially formed as separate components.

12. A lighting fixture for attachment to an architectural surface structure and adapted to hold a light source, the lighting fixture comprising:

a base plate;

first and second mounting brackets, each mounting bracket including a rear panel coupled to the base plate and a front panel joined to the rear panel by a side wall to define a receptacle between the front panel and the base plate, the receptacle having a depth defined by a spacing distance between the front panel and the base plate sufficient to receive an edge of the light source, each front panel further defining an inner terminal edge, the first and second mounting brackets being oriented such that the receptacles diametrically oppose one another, the first and second mounting brackets further being positioned such that the front panel inner terminal edges are laterally spaced from one another to define a lighting opening;

a first clamp having a base end coupled to the first mounting bracket rear panel and a spring configured to extend at least partially toward the first mounting bracket front panel, thereby to generate a biasing force directed toward the first mounting bracket front panel; and a second clamp having a base end coupled to the second mounting bracket rear panel and a spring configured to extend at least partially toward the second mounting bracket front panel, thereby to generate a biasing force directed toward the second mounting bracket front panel.

13. The lighting fixture of claim 12, in which the spring comprises a spring arm.

14. The lighting fixture of claim 12, in which the spring comprises a spring end opposite the base end.

15. The lighting fixture of claim 14, in which each of the first and second clamps further comprises a stop disposed between the base end and the spring end, the stop extending toward the front panel of the respective mounting bracket.

16. The lighting fixture of claim 14, in which each of the first and second clamps further comprises a spring arm disposed between the base end and the spring end, the spring arm being configured to bias an edge of the light panel in a lateral direction toward the lighting opening.

17. The lighting fixture of claim 12, in which each mounting bracket further comprises a bearing structure extending from an interior face of the front panel.

18. The lighting fixture of claim 17, in which the bearing structure comprises an inclined surface.

19. The lighting fixture of claim 12, in which each mounting bracket further comprises a lip located at the terminal end of the front panel and extending from an exterior face of the front panel.

20. The lighting fixture of claim 12, in which each receptacle depth defined by the first and second mounting brackets is approximately ⅛ to 2 inches.

21. The lighting fixture of claim 12, in which the base plate extends laterally outward from each of the first and second mounting bracket side walls to define a first exterior socket between the base plate and the first mounting bracket front panel and a second exterior socket between the base plate and the second mounting bracket front panel, wherein the first and second exterior sockets are sized to receive edges of the architectural surface structure.

* * * * *